US012239233B2

(12) United States Patent
Malzl et al.

(10) Patent No.: US 12,239,233 B2
(45) Date of Patent: Mar. 4, 2025

(54) VALVE SYSTEM

(71) Applicants: Alexander Malzl, Henndorf am Wallersee (AT); Andreas Malzl, Henndorf am Wallersee (AT); Johannes Malzl, Neumarkt am Wallersee (AT); Hans Malzl, Salzburg (AT)

(72) Inventors: Alexander Malzl, Henndorf am Wallersee (AT); Andreas Malzl, Henndorf am Wallersee (AT); Johannes Malzl, Neumarkt am Wallersee (AT); Hans Malzl, Salzburg (AT); Wolfgang Huber, Berndorf (AT); Robert Zuckerstätter, Puch bei Hallein (AT)

(73) Assignees: Andreas Malzl, Henndorf Am Wallersee (AT); Johannes Malzl, Neumarkt Am Wallersee (AT); Hans Malzl, Salzburg (AT)

( * ) Notice: Subject to any disclaimer, the term of this patent is extended or adjusted under 35 U.S.C. 154(b) by 6 days.

(21) Appl. No.: 17/769,656

(22) PCT Filed: Oct. 15, 2020

(86) PCT No.: PCT/AT2020/060374
§ 371 (c)(1),
(2) Date: Apr. 15, 2022

(87) PCT Pub. No.: WO2021/072471
PCT Pub. Date: Apr. 22, 2021

(65) Prior Publication Data

US 2024/0148159 A1 May 9, 2024

(30) Foreign Application Priority Data

Oct. 16, 2019 (AT) ..... A 50889/2019

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01); *A47C 27/083* (2013.01)

(58) Field of Classification Search
CPC ..... A47C 27/08; A47C 27/081; A47C 27/082; A47C 27/083; A47C 27/084; A47C 27/10
See application file for complete search history.

(56) References Cited

U.S. PATENT DOCUMENTS 5,904,172 A * 5/1999 Gifft ..... A47C 27/082 137/271
2008/0028533 A1* 2/2008 Stacy ..... A61G 7/015 5/713

(Continued)

FOREIGN PATENT DOCUMENTS

| | | | |
|---|---|---|---|
| EP | 1884224 | A2 | 2/2008 |
| EP | 3449774 | A1 | 3/2019 |
| WO | 2011048072 | A1 | 4/2011 |

*Primary Examiner* — George Sun
(74) *Attorney, Agent, or Firm* — Dykema Gossett PLLC

(57) ABSTRACT

Various aspects of the present disclosure are directed to a valve system. In one example embodiment, a valve system is disclosed including: at least two compressed air valves that pressurize/inflate an object by means of compressed air, the object having at least two air chambers which are independent of one another, a printed circuit board including first and second surfaces, a supply opening and at least one outlet bore, and at least one compressed air inlet. Where the at least two compressed air valves are each associated with a respective one of the at least two chambers, and at least one compressed air valve is arranged on the first surface of the printed circuit board, and the second surface of the printed circuit board opposite the first surface acts as a sealing surface for the at least one compressed air inlet.

14 Claims, 3 Drawing Sheets

(56) References Cited

U.S. PATENT DOCUMENTS

| | | | | |
|---|---|---|---|---|
| 2008/0181795 | A1* | 7/2008 | Feingold | F04B 39/121<br>417/282 |
| 2011/0095216 | A1* | 4/2011 | deGreef | G05D 7/0664<br>251/129.15 |
| 2018/0073948 | A1* | 3/2018 | Moniaci | G01L 19/0038 |
| 2018/0335042 | A1* | 11/2018 | Lin | F04D 27/001 |
| 2019/0170136 | A1* | 6/2019 | Gomez Vinagre | A47C 27/08 |
| 2020/0248706 | A1* | 8/2020 | Liu | F04D 25/084 |

* cited by examiner

VALVE SYSTEM

CROSS-REFERENCE TO RELATED APPLICATIONS

This application is a national stage filing based upon International application No. PCT/AT2020/060374, filed 15 Oct. 2020, which claims the benefit of priority to Austria application No. A 50889/2019, filed 16 Oct. 2019.

BACKGROUND

The invention relates to a valve system having at least two compressed air valves for an object which can be pressurized/inflated by means of compressed air and has at least two air chambers which are independent of one another, in particular a mattress, wherein at least one compressed air valve can be associated with each air chamber, wherein the at least one compressed air valve is arranged on a first surface of a printed circuit board, and a second surface of the printed circuit board, which is opposite the first surface, is designed as a sealing surface for at least one compressed air inlet, and its use for controlling the pressure within at least one air chamber of a measuring mattress.

Measuring mattresses, such as those described in EP 2 490 575 B1, are used to adapt a foam sleeping mattress to individual requirements, in particular to select the various areas with different foam hardnesses. These measuring mattresses have individually controllable air chambers to which different air pressures can be applied in order to simulate the different foam hardnesses in these areas. A wide variety of valve systems are used to control the individual pressures in the respective air chambers.

In EP 3 449 774 A1, a valve system of the type mentioned at the beginning is described, wherein an air chamber is formed between two printed circuit boards, which is in communication with the measuring mattress, and wherein at least one compressed air valve is provided, which controls the pressure in this air chamber between the two printed circuit boards. Further valve systems are described, for example, in U.S. Pat. No. 5,904,172 A or US 2011/0095216 A1.

The valve systems described in the prior art are largely complex in design and/or require specially manufactured components and valves in order to be suitable for use in conjunction with measuring mattresses.

It is therefore the object of the invention to provide a valve system that can be manufactured in a simple manner and can be set up quickly and easily using essentially standard components.

This object is solved by a valve system of the type mentioned above in that a substantially plate-shaped distributing element with a first surface is provided, wherein a connecting element for the supply of compressed air is provided on the distributing element, which connecting element is fluidically connected to the at least one compressed air inlet, wherein the at least one compressed air inlet is arranged on the first surface of the distributing element, wherein the at least one compressed air inlet is fluidically connected to the at least one compressed air valve via at least one supply opening in the circuit board, wherein at least one outlet opening is provided in the circuit board, and wherein the at least one outlet opening connects the at least one compressed air valve in a fluid-tight manner to at least one outlet conduit arranged inside the distributing element.

SUMMARY OF THE INVENTION

It is provided according to the invention that the compressed air valves for controlling the individual air chambers on the measuring mattress or other inflatable object having a plurality of air chambers are arranged on a printed circuit board. The distributing element according to the invention has a connection for the supply of compressed air as well as a plurality of compressed air outlets which are connected to the corresponding air chambers, for example of the measuring mattress. Within this distributing element, supply conduits to the compressed air valves as well as outlet conduits from the compressed air valves to the compressed air outlets are arranged, which allows a particularly space-saving design of the valve system according to the invention. Likewise, only standard components are required, in particular commercially available solenoid valves are used as compressed air valves.

In a particularly preferred embodiment of the invention, it is provided that at least one pressure sensor is arranged in the at least one outlet conduit. The arrangement of a pressure sensor in the outlet conduit allows a particularly reliable measurement of the overpressure currently prevailing in the outlet conduit and subsequently in the air chamber of the measuring mattress associated with the compressed air outlet. In particular, this measurement is also carried out independently of the pressure prevailing in the compressed air inlet as well as the other individual compressed air outlets and can be carried out in particular when the compressed air valve is closed.

This measurement in the outlet conduit becomes particularly reliable if the at least one outlet conduit has at least one sensor opening, which is preferably accessible via the first surface of the distributing element, wherein the at least one pressure sensor is arranged in the sensor opening. This sensor opening also makes it possible to quickly replace any defective pressure sensor.

In another preferred embodiment of the invention, a compressed air chamber is provided between the at least one compressed air valve and the first surface of the printed circuit board into which the at least one supply opening opens. Thus, an independent compressed air chamber is formed between each individual compressed air valve and the first surface of the printed circuit board, allowing a uniform supply of compressed air to the compressed air valve.

A particularly space-saving design of the valve system according to the invention is achieved if the at least one outlet opening penetrates the compressed air chamber and is sealed in a fluid-tight manner against the compressed air chamber, which is preferably designed as an annular gap.

Since compressed air valves usually generate heat during operation, it is provided in a further embodiment of the invention that at least one receptacle for the arrangement of a sensor and/or switch element, in particular at least one temperature switch, is provided in the distributing element. If the temperature of the distributing element exceeds a presettable threshold value, the entire valve system is de-energized to prevent overheating, in particular of the sealing elements.

The distributing element according to the invention is particularly easy to manufacture if it is made of metal, in particular aluminum or an aluminum alloy.

The valve system according to the invention has proven itself in particular when used to control the pressure within at least one air chamber of a measuring mattress.

BRIEF DESCRIPTION OF THE DRAWING

In the following, the invention is explained in more detail by means of a non-limiting exemplary embodiment with associated figures, wherein.

DETAILED DESCRIPTION

Figure 1:
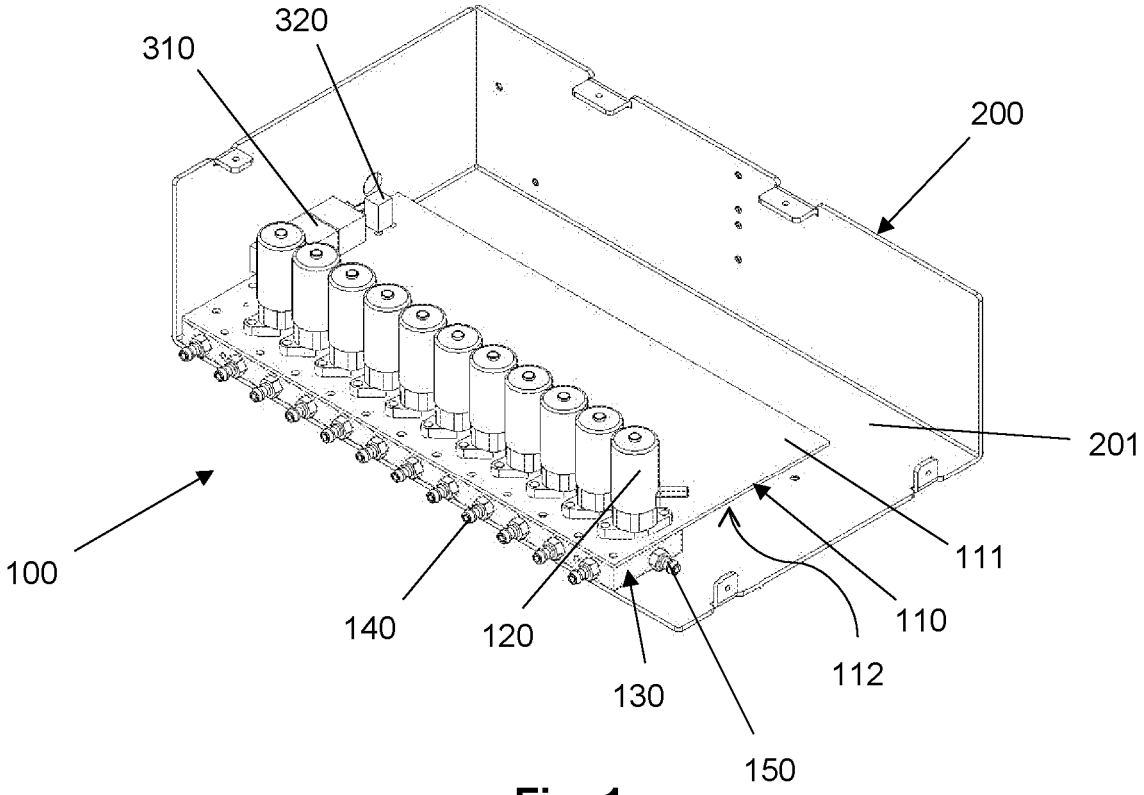
FIG. 1 shows a schematic representation of the valve system according to the invention.

FIG. 1 shows a perspective view of the valve system 100 according to the invention, which in this embodiment of the invention is housed in a housing 200. A printed circuit board 110 is arranged in this housing 200, on a first surface 111 of which compressed air valves 120 are mounted in a fluid-tight manner. These compressed air valves 120 are, for example, solenoid valves known per se, such as are commonly used in pneumatic systems.

A substantially plate-shaped distributing element 130 is arranged between the printed circuit board 110 and the housing base 201 on a second surface 112 of the printed circuit board 110, which distributing element 130 has compressed air outlets 140, each of which is assigned to a pressure valve 120. Furthermore, a pump connection 150 is arranged on this distributing element 130, which can be connected to a compressed air pump 1200 (FIG. 5) that supplies the valve system 100 according to the invention with compressed air.

In addition, further sensor and control elements 310, 320 are arranged on the printed circuit board 110, which serve to monitor and control the valve system 100 according to the invention.

Figure 2:
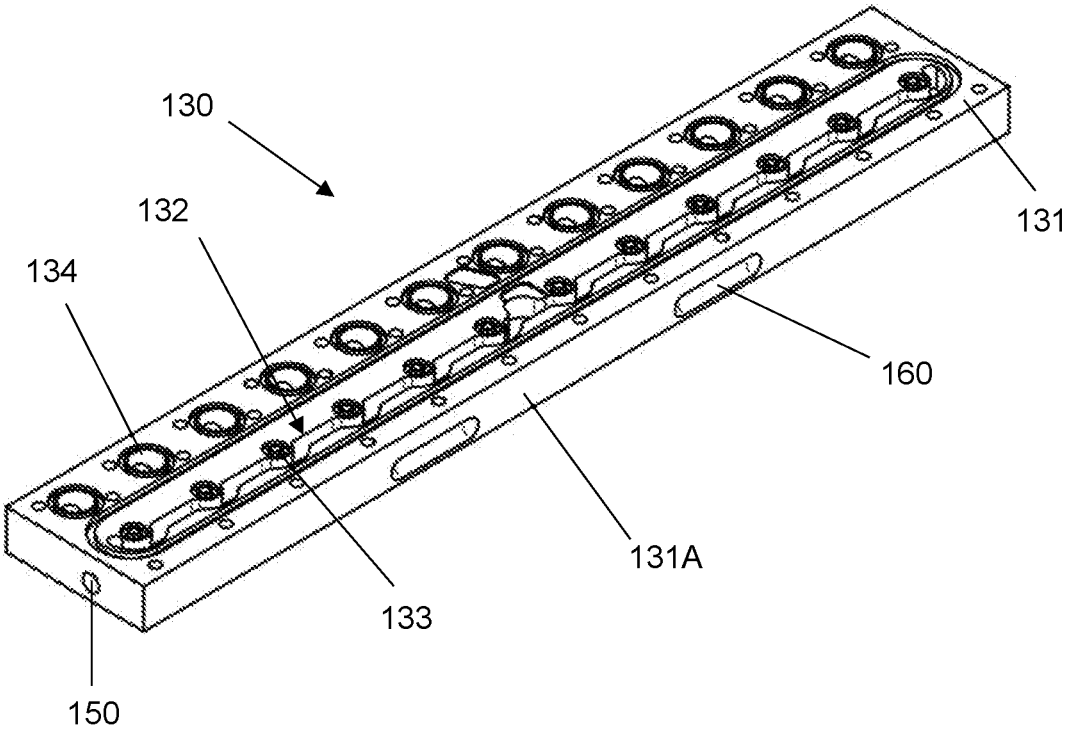
FIG. 2 shows a distributing element of the valve system of FIG. 1 in a detailed perspective view.

FIG. 2 shows the distributing element 130 according to the invention in detail. On a first surface 131 of the distributing element 130, which faces the second surface 112 of the printed circuit board 110 in the position of use, a meander-shaped compressed air inlet 132 is arranged, which is in fluid connection with the compressed air valves 120 via respective supply holes in the printed circuit board 110. This compressed air inlet 132 is sealed by the second surface 112 of the printed circuit board 110 in the position of use.

Compressed air flows into the compressed air inlet 132 via the pump connection 150. The meandering design of the compressed air inlet 132 allows a uniform supply of compressed air to the compressed air valves 120.

The compressed air inlet 132 also includes outlet openings 133, each of which connects a compressed air valve 120 to an outlet conduit within the distributing element 130 and subsequently to a compressed air outlet 140.

Furthermore, sensor openings 134 are arranged on the first surface 131 of the distributing element 130. In the position of use, these sensor openings 134 are also sealed with respect to the second surface 112 of the printed circuit board 110.

Finally, the distributing element 130 according to the invention has recesses 160 on a side surface 131A for receiving temperature switches (not shown). Since the compressed air valves 120 usually generate a lot of heat during operation, these temperature switches monitor the temperature of the distributing element 130, which is preferably made of aluminum or an aluminum alloy. As soon as a certain, predeterminable temperature threshold is exceeded, the valve system 100 according to the invention is de-energized. In this way, damage, in particular to sealing elements or to the compressed air valves 120, is avoided. Further such temperature switches can also be provided, for example, on the printed circuit board 110 or on the housing 200.

Figure 3:
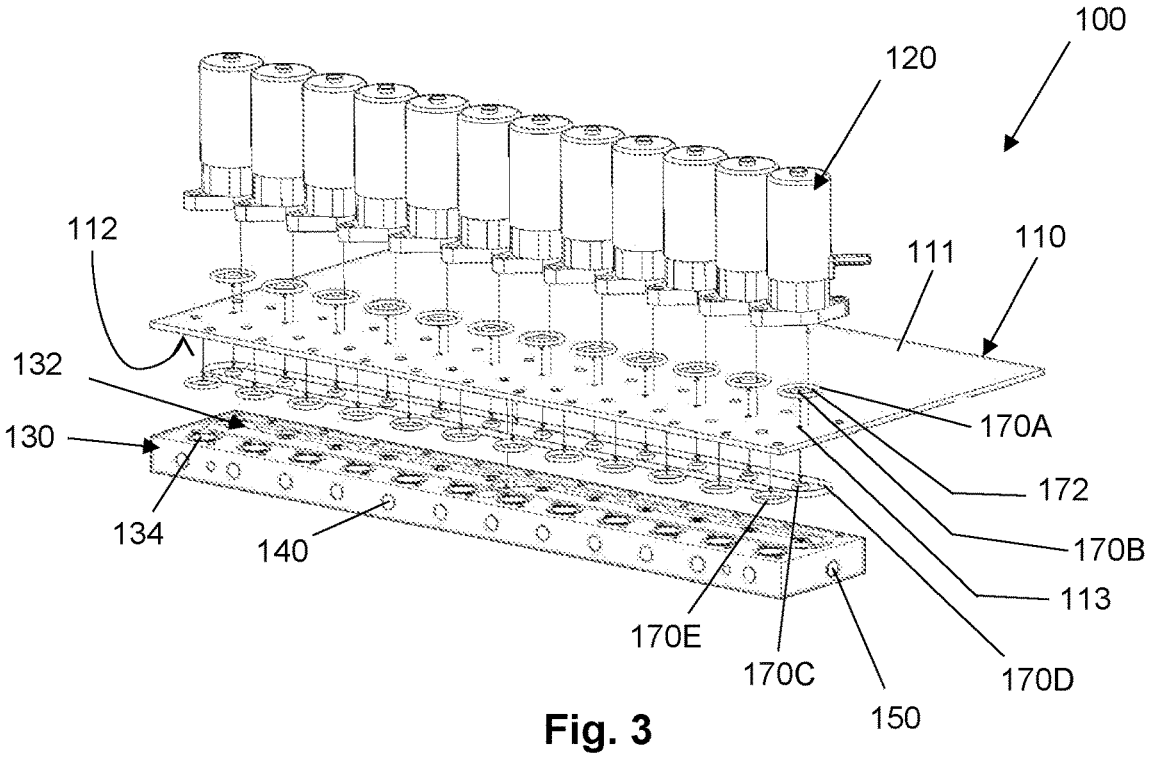
FIG. 3 shows an exploded view of the valve system according to the invention.
Figure 4:
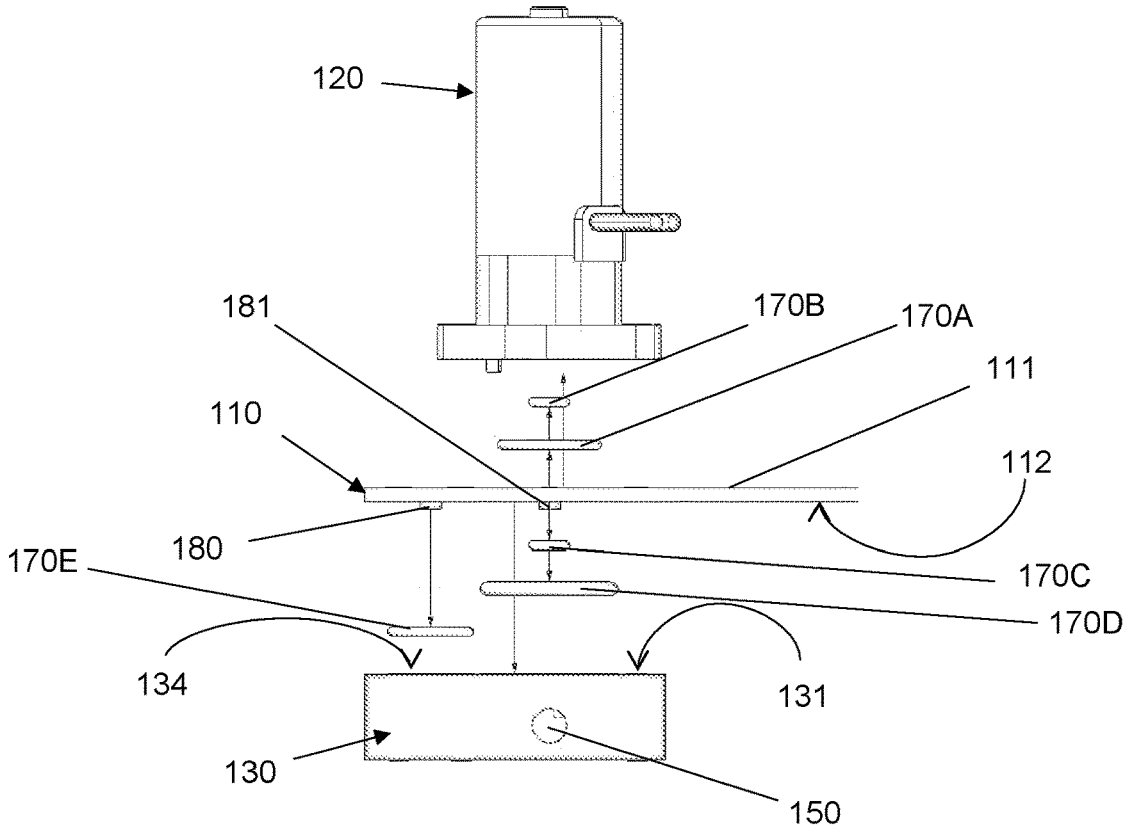
FIG. 4 shows an exploded view of the arrangement of a pressure valve in the valve system.

In FIGS. 3 and 4, an exploded view schematically shows the structure of the valve system 100 according to the invention.

The compressed air valves 120 are sealed with respect to the first surface 111 of the printed circuit board 110 by means of a first sealing ring 170A and a second sealing ring 170B. Here, the second sealing ring 170B is arranged with its smaller diameter within the area of the first sealing ring 170A, in particular concentrically. A further third sealing ring 170C is arranged on the first surface 131 of the distributing element 130, which interacts with the second surface 112 of the printed circuit board 110 and is enclosed by a further sealing ring 171D surrounding the compressed air inlet 132.

At least one supply opening (not shown) is provided in the printed circuit board 110, which is arranged in a region between the first sealing ring 170A and the second sealing ring 170B. Furthermore, an outlet bore 113 is provided in the printed circuit board 110, which connects the respective pressure valve 120 to the respective outlet opening 133 in the distributing element 130 and subsequently to the respective outlet conduit in the distributing element 130. This outlet bore 113 is sealed in a fluid-tight manner with respect to the pressure valve 120 and the first surface 111 of the printed circuit board 110 by the second sealing ring 170A, and with respect to the first surface 131 of the distributing element 130 and the second surface 111 of the printed circuit board 110 by the third sealing ring 170C.

If compressed air is now fed into the compressed air inlet 132 via the pump connection 150 while the compressed air valve 120 is closed, the compressed air is enclosed between the first surface 111 of the printed circuit board 110 and the bottom of the compressed air valve 120 in the compressed air chamber 172 formed by the two sealing rings 170A, 170B, which is formed as an annular gap.

Once the compressed air valve 120 is opened, the compressed air flows through the compressed air valve 120 and passes through the printed circuit board 110 via the outlet bore 113 into the outlet opening 133 in the distributing element 130 and is then directed to the compressed air outlets 140.

Figure 5:
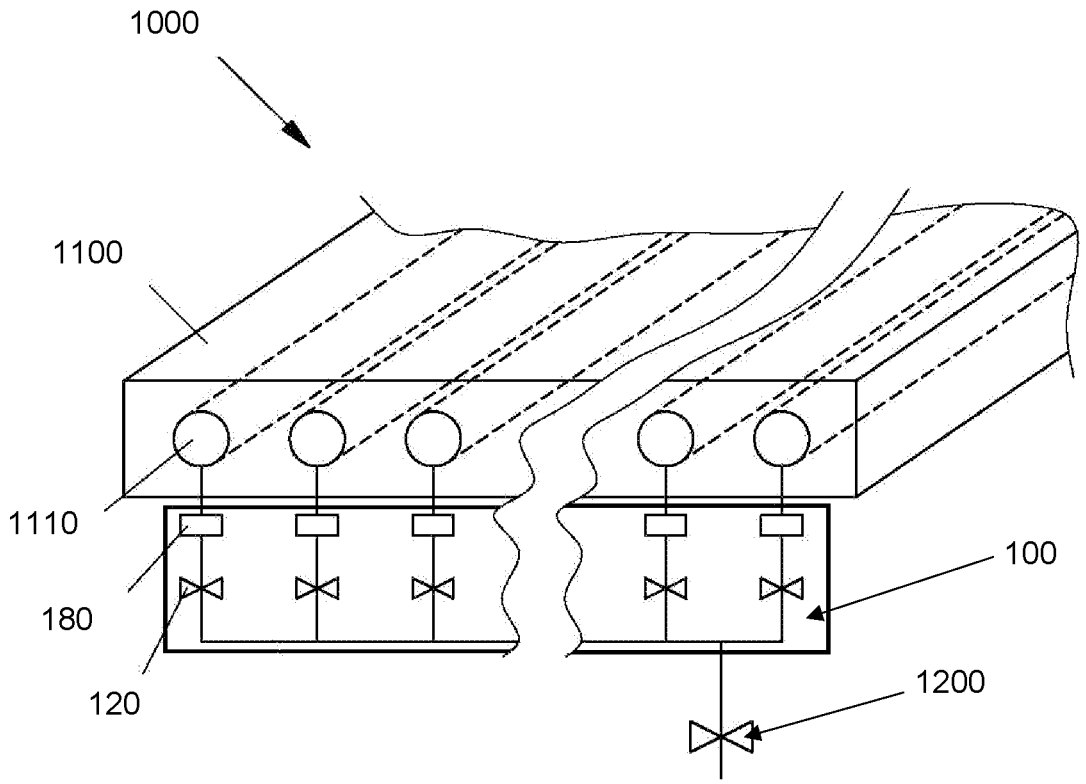
FIG. 5 shows a schematic representation of a measuring mattress with associated valve system from FIG. 1.

These compressed air outlets 140 are connected to respective air chambers 1110 of the inflatable object 1000 (FIG. 5). Via the compressed air valves 120, these air chambers 1110 can be independently supplied with compressed air at different pressures. In this case, the compressed air is first supplied via the distributing element 130 to the respective compressed air valve 120 arranged on the printed circuit board 110, and when the compressed air valve 120 is open, it is again supplied back through the printed circuit board 110 into the distributing element 130, and supplied to the corresponding compressed air outlet 140.

Preferably, a system of pressure sensors 180 is provided for measuring and controlling the pressure in the individual air chambers 1110. In the embodiment of the invention shown here (FIG. 4), a pressure sensor 180 is arranged in the region of the sensor bore 135 of each compressed air outlet 140. Here, the sensor bore 135 is arranged on the second surface 112 of the printed circuit board 110 and is sealed in a fluid-tight manner by means of a sealing ring 170E. This pressure sensor 180 has the task of determining the differential pressure in the compressed air outlet 140 or the inflatable object connected thereto relative to the external pressure.

In addition, an absolute pressure sensor 181 is arranged in the compressed air inlet 132, which monitors the absolute pressure in the compressed air inlet 132. With the aid of this absolute pressure sensor 181, a possible defective pressure valve 120 can be detected by an undesired pressure increase in the compressed air inlet 132, although the pressure in the compressed air outlet 140 itself does not change.

Finally, FIG. 5 schematically shows a measuring mattress 1000 having a base body 1100 and tubular air chambers 1110, wherein each air chamber 1110 can be separately supplied with compressed air. For this purpose, the valve system 100 according to the invention is connected to a pump 1200 for the required compressed air, wherein the compressed air is supplied to these air chambers 1110 via the compressed air valves 120 in the manner described above. The pressure measurement in the individual air chambers 1110 is here obtained via pressure sensors 120, which are arranged between the measuring mattress 1000 and the compressed air valves 120, which are arranged within the valve system 100 according to the invention, as shown in particular in FIG. 4.

It is understood that the present invention is not limited to the embodiment described above. In particular, different compressed air valves as well as their different arrangement on a printed circuit board may be provided. Essential to the invention is the distributing element which, due to its stable design made of metal, allows reliable and simple distribution of the compressed air to the individual compressed air valves. The arrangement of pressure sensors in this distributing element in the area of the compressed air outlets according to the invention permits a particularly precise and controlled measurement of the overpressure prevailing in the inflatable object. It is understood that the valve system according to the invention is not only suitable for pressure build-up in the inflatable object, but also allows controlled pressure reduction in selected areas of the inflatable object, in particular in the air chambers of a measuring mattress.

The invention claimed is:

1. A valve system comprising:

at least two compressed air valves configured and arranged to pressurize/inflate an object by means of compressed air, the object having at least two air chambers which are independent of one another;

a printed circuit board including first and second surfaces, a supply opening and at least one outlet bore;

at least one compressed air inlet;

wherein the at least two compressed air valves are each associated with a respective one of the at least two chambers, wherein at least one compressed air valve of the at least two compressed air valves is arranged on the first surface of the printed circuit board, and the second surface of the printed circuit board opposite the first surface is configured and arranged to act as a sealing surface for the at least one compressed air inlet;

a substantially plate-shaped distributing element having a first surface, at least one outlet conduit and at least one outlet opening;

a connection for the supply of compressed air is provided at the distributing element which is in fluid connection with the at least one compressed air inlet;

wherein the at least one compressed air inlet is arranged on the first surface of the distributing element, wherein the at least one compressed air inlet is in fluid connection with the at least one compressed air valve via the at least one supply opening in the printed circuit board;

wherein the at least one outlet bore connects the at least one compressed air valve in a fluid-tight manner to the at least one outlet conduit via the at least one outlet opening, and wherein the at least one outlet conduit is configured and arranged to be connected to the object.

2. The valve system according to claim 1, further including at least one pressure sensor arranged in the at least one outlet conduit.

3. The valve system according to claim 2, characterized in that the at least outlet conduit has at least one sensor opening, wherein the at least one pressure sensor is further arranged in the at least one sensor opening.

4. The valve system according to claim 1, further including a compressed air chamber between the at least one compressed air valve and the first surface of the printed circuit board, into which the at least one supply opening is configured and arranged to open into.

5. The valve system according to claim 4, characterized in that the compressed air chamber is formed as an annular gap.

6. The valve system according to claim 1, further including at least one receptacle (160) for the arrangement of a sensor and/or switch element, is provided in the distributing element.

7. The valve system according to claim 1, characterized in that the distributing element is made of metal.

8. Method of use of the valve system according to claim 1 for controlling the pressure within the at least one air chamber of the object.

9. Measuring mattress comprising:

at least two air chambers which can be inflated by means of compressed air, and the valve system of claim 1 including the compressed air valve is configured and arranged to regulate the supply and discharge of compressed air.

10. The valve system of claim 3, wherein the at least one sensor opening is accessible via the first surface of the distributing element.

11. The valve system of claim 6, wherein the sensor and/or switch element is a temperature switch.

12. The valve system of claim 7, wherein the distributing element is aluminum or an aluminum alloy.

13. The valve system of claim 1, wherein the object is a mattress.

14. The method of using the valve system of claim 8, wherein the object is a mattress.

* * * * *